United States Patent [19]

Williams et al.

[11] Patent Number: 4,999,524

[45] Date of Patent: Mar. 12, 1991

[54] SOLAR ARRAY POWER SIMULATOR

[75] Inventors: Anthony B. Williams; Kenneth M. Redford; Scott Mitchell; Richard N. Bussell, all of Bristol, United Kingdom

[73] Assignee: British Aerospace Public Limited Company, London, England

[21] Appl. No.: 434,819

[22] Filed: Nov. 13, 1989

[30] Foreign Application Priority Data

Nov. 12, 1988 [GB] United Kingdom ..... 8826515
Aug. 2, 1989 [GB] United Kingdom ..... 8917642

[51] Int. Cl.[5] ..... G05F 1/563

[52] U.S. Cl. ..... 307/54; 323/224; 323/906

[58] Field of Search ..... 323/224, 225, 223, 271, 323/272, 286, 287, 906; 307/54, 58

[56] References Cited

U.S. PATENT DOCUMENTS 4,761,722 8/1988 Pruitt ..... 323/224
4,789,818 12/1988 Furuta ..... 323/287

FOREIGN PATENT DOCUMENTS 16623 9/1971 Japan ..... 323/906
868924 9/1981 U.S.S.R. ..... 323/906
877502 10/1981 U.S.S.R. ..... 323/272
915186 3/1982 U.S.S.R. ..... 323/906
922699 4/1982 U.S.S.R. ..... 323/906
913130 12/1962 United Kingdom .

*Primary Examiner*—William H. Beha, Jr.
*Attorney, Agent, or Firm*—Young & Thompson

[57] ABSTRACT

A power supply for supplying power to a switched regulator includes a programmable voltage source 14, a constant voltage source 12 and a programmable switched mode current source 16 connected in series between the positive and negative outputs. A catching diode 18 is connected in parallel with the constant voltage source 12 and the current source 16. The supply operates to provide a controlled current at the output, irrespective of the load voltage.

15 Claims, 3 Drawing Sheets

SOLAR ARRAY POWER SIMULATOR

This invention relates to power supplies and parts thereof.

In particular, but not exclusively, this invention relates to solar array power simulator modules. Solar array power simulator modules are power sources which are used to provide electrical energy to spacecraft electrical equipment during ground testing. Solar array power simulator modules contain a voltage source and a current source which are controlled to be interdependent in such a manner as to mimic the voltage—current relationship of a solar array string. A typical voltage—current relationship of a solar array string is shown in FIG. 1 of the accompanying drawings.

Conventional solar array power simulators are usually specific to a single type of spacecraft. When spacecraft with differing solar arrays are to be powered by a power simulator, new solar array power simulators have to be designed.

Existing linear types of solar array power simulator are inefficient in the use of the electrical energy supplied. Also they are physically heavier than the switched mode type and their electrical performance can be degraded by the appearance of parasitic oscillations at the output. Switched mode simulators may be more efficient but their performance may be limited by the noise induced in the current sensors, by the low bandwidth of the current control loop (necessary for stability) and by the injection of current ripple and spikes into the output lines from the internal circuitry of the solar array power simulator module.

Broadly stated, according to one aspect of this invention, there is provided a power supply for supplying power to a series and/or shunt switched regulator, said power supply comprising positive and negative output means, a first and a second voltage source and a current source connected in series between said output means, and by-pass means connected in parallel with said current source and one of said first and second voltage sources and operable so that when said output means are open circuit only said one voltage source is applied across said current source, but when said output means are shorted both said voltage sources are applied across said current source.

In another aspect there is provided a switched mode power supply including a voltage source, switch means, inductor means, a relatively slow control loop responsive to the current flowing in said inductor means to apply a pulse width modulated switching signal to said switch means, and a relatively fast control loop responsive to the voltage across said inductor means for modifying said switching signal to compensate for changes in said inductor voltage.

In yet another aspect there is provided an inductor comprising a relatively low capacitance single layer winding inductor section in series with a plurality of multi-layer winding sections.

A specific embodiment of the invention will now be described by way of example only, reference being made to the accompanying drawings, in which.

Figure 1:
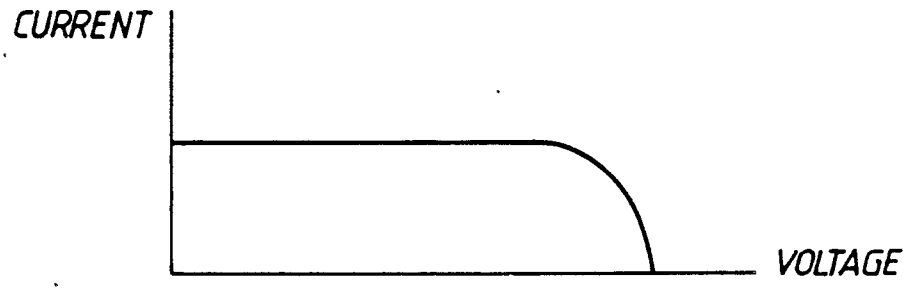
FIG. 1 is a graph illustrating the typical shape of the voltage-current relationship of a solar array string.
Figure 2:
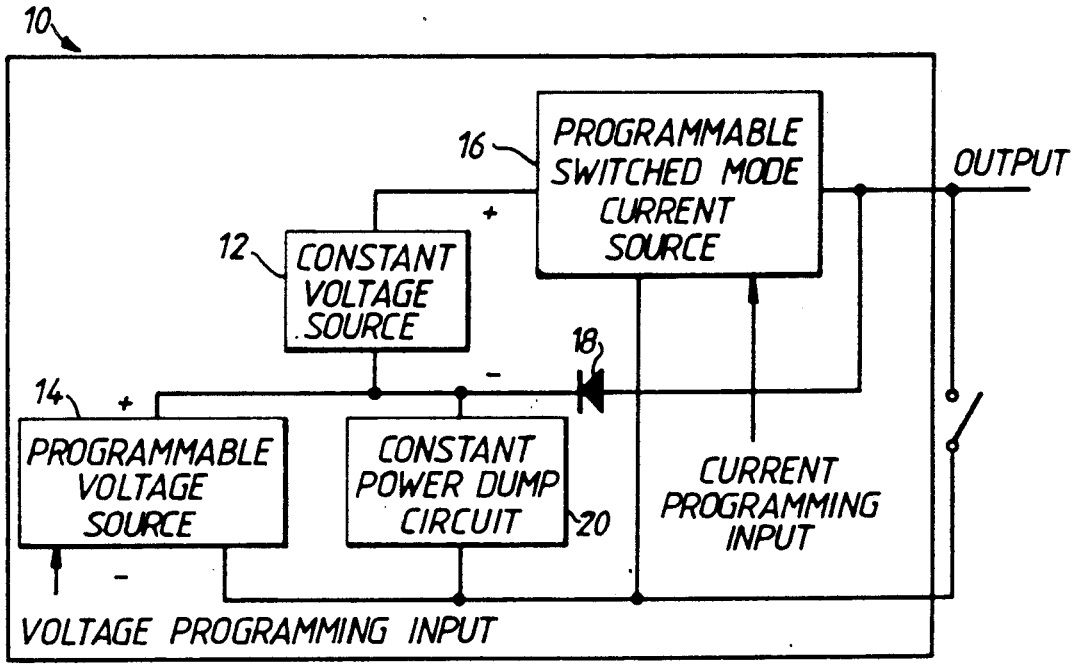
FIG. 2 is a system diagram of a general purpose solar array power simulator module.

Referring initially to FIG. 2, an example of solar array power simulator module 10 in accordance with the invention comprises a constant voltage source 12 (typically set at 15 volts) connected in series with a programmable voltage source 14 (typically variable over the range 0 to 150 volts) and a programmable switched mode current source 16 (typically variable over the range 0 to 12 amps). A catching diode 18 is connected in parallel with the current source 16 and the constant voltage source 12. A constant power dump circuit 20 is connected in parallel with the programmable voltage source 14 and is operable to dissipate constant power (e.g. 160 watts) should the voltage at the programmable voltage source 14 exceed a threshold level, as to be described below.

Figure 3:
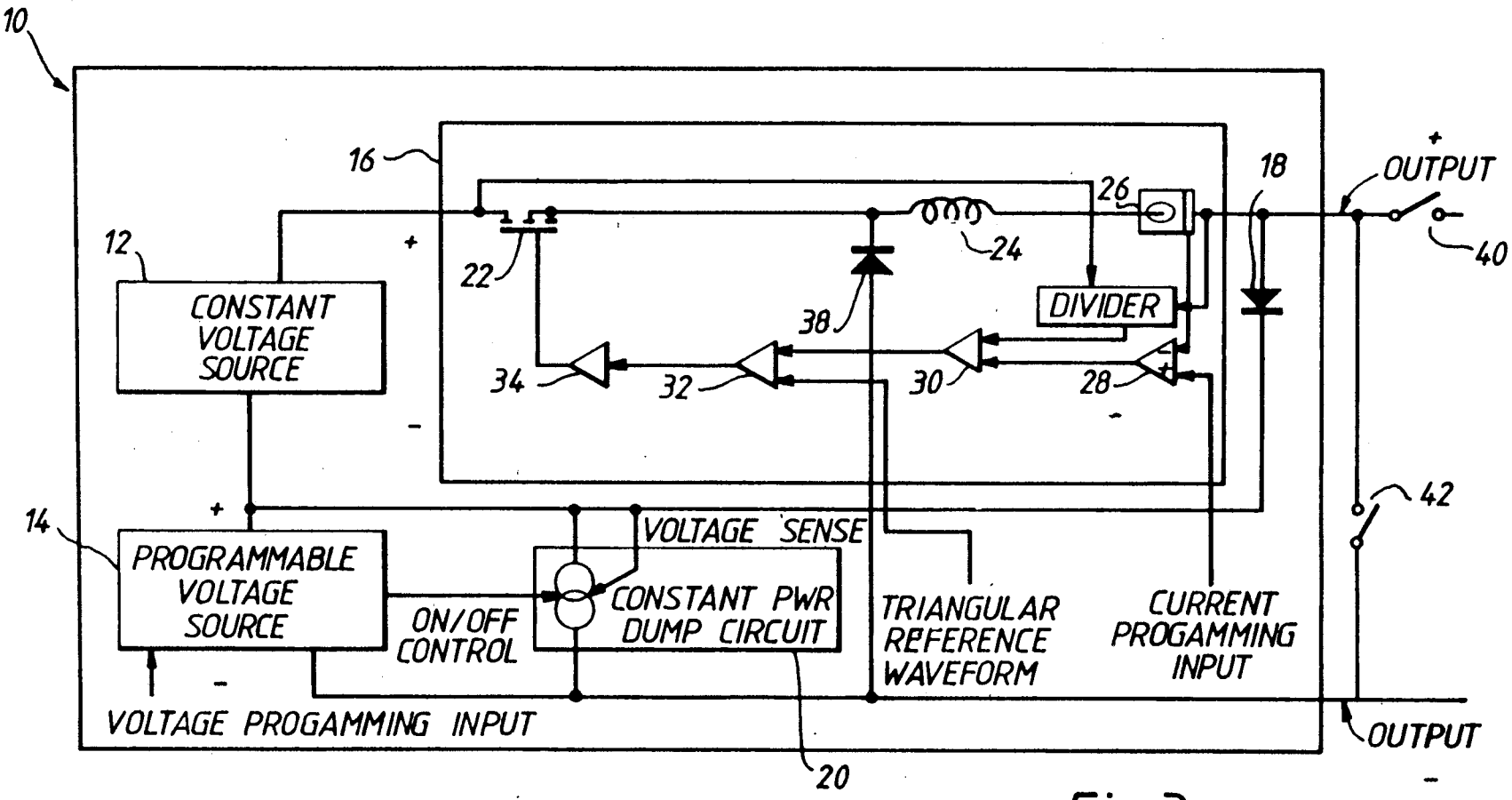
FIG. 3 is an outline circuit diagram of the solar array power simulator module of FIG. 2.

Referring to the more detailed view of FIG. 3 the switched mode programmable current source comprises a MOSFET power switch 22 and an inductor 24 typically of 20 mH and of special construction as to be described with reference to FIGS. 4 to 8 below. The switch 22 is controlled by a pulse-width-modulated signal and operates at a fixed frequency of typically 100 KHz with a variable duty cycle of 0 to 100% as dictated by control loop action.

The complete control scheme comprises two loops. A relatively slow main control loop with a bandwidth of a few kHz regulates the average amplitude of the current flowing in the inductor 24 and comprises an isolated Hall effect sensor 26, an error amplifier 28, a summing amplifier 30, a comparator 32 for generating a pulse width modulated output signal, a MOSFET switch driver 34, the power switch 22 and the inductor 24. A relatively fast control loop with a bandwidth of at least 100 KHz compensates for changes in voltages across the inductor and couples dynamic changes into the main loop. The fast loop comprises a divider 36 to which the inductor input and output voltages are supplied, the output from the divider being fed to the summing amplifier 30. The switched mode current source also includes a fast recovery flyback diode 38 which clamps the input end of the inductor to the negative side of the programmable voltage source 14.

A typical load section for the simulator module can include either a modulated series load switch 40 or a modulated shunt load switch 42 each capable of being modulated at a frequency in the range of from 0 to 25 KHz; as such, the module can operate as a general purpose array, operating into a series switched or a shunt switched sequential shunt switch regulator, or a battery, or a switched mode power supply etc.

In use the pulse width modulated voltage output from the power switch 22 is integrated by the inductor 24 which is set large enough (20 mH in this example) to produce a substantially constant current output with a low ripple content. As described below, the inductor 24 is of a special construction in order to reduce its stray capacitance.

When the power switch 22 is on, the current in the inductor increases according to the equation:

$$i = \int \frac{e}{L} dt$$

where e represents the potential difference across the inductor value L henries.

When the switch 22 opens, the voltage on the cathode of the flyback diode 38 instantaneously swings downwards until the flyback diode becomes forward biased. The inductor 24 is now clamped at one end to the negative end of the programmable voltage source. Its other end, with the load switches 40 and 42 open circuit (as in FIG. 3) will be clamped to the positive side of the programmable voltage source 14.

Load switches 40 and 42 will never be on simultaneously, so that they will either clamp the inductor 24 to the output load voltage (when the series load switch 40 is short circuit) or to the negative side of the programmable voltage source 14. The dynamic variation of the current in the inductor 24, when switch 22 is open, is controlled by the equation:

$$i = -\int \frac{e}{L} dt$$

Thus the current will decay. In use the current is maintained at a constant desired level by adjusting the duty cycle of the PWM signal.

Consider the operation of the main loop. Assume for convenience of the explanation, that the load switch 42 is closed and that a fixed D.C. voltage reference is present at the current programming input of the error amplifier 28. At start up, there will be no current flowing in the inductor 24, so that there will be no output signal from the current sensor 26. Thus the output from the error amplifier 28 will be at a maximum. The output from the divider 36 will be virtually zero, since the numerator will be the voltage at the anode of the catching diode 18, which, in this case, will be virtually zero, due to the fact that the load switch 42 is closed.

The error amplifier output will appear as an input to the comparator 32. Since this input is at a maximum, the output duty cycle of the pulse width modulator will be at or near 100%. Thus the power switch 22 will be virtually continuously closed. The total voltage of the series connection of the constant voltage source 12 and the programmable voltage source 14 will therefore be impressed across the inductor 24. As a direct result, the current in the inductor 24 will ramp up, the output from the current sensor 26 will ramp up, the output from the error amplifier 28 will ramp downwards, and the duty ratio will fall below 100%. As the duty ratio falls below 100%, the average rate of rise of the current in the inductor 24 will also fall, since during the power switch off period, the average level of current in the inductor 24 will fall.

Eventually, the output from the error amplifier 28 and hence the input to the comparator 32 will be at such a level that the duty ratio on the power switch 22 will ensure that the rise in inductor 24 current, during the power switch on period, will be equal to the fall in current amplitude during the off period so that the output signal amplitude from the current sensor 26 will be approximately equal to the amplitude of the fixed D.C. voltage reference input to the error amplifier 28.

The output current will also vary as the D.C. reference voltage input to the error input amplifier 28 is varied so that the current in the inductor 24 can be modulated sinusoidally, half sinusoidally or by some other waveshape, within the limits of bandwidth constraints, inductive energy constraints, etc.

When either of the load switches 40 or 42 is being pulse width modulated at a frequency in the range 0 to 25 KHz, the operation of the main control loop will be directly affected. For example, if load switch 42 is being modulated at some nominal frequency, then during the power switch 22 on period, the rate of rise of current in the inductor 24 will be lower during the period that the load switch 42 is off than it will be during the period when the load switch 42 is turned on.

This is due to the fact that during the period that the load switch 42 is off, the catching diode 18 is forward biased and since the power switch 22 is on, the total voltage across the inductor is equal to that of the constant voltage source 12 (15 volts in this case). When the load switch 42 is closed, the catching diode 18 is reverse biased, its anode being shorted by the load switch 42 to the negative side of the programmable voltage source 14. Thus, the total voltage appearing across the inductor 24 will now be equal to that of the constant voltage source 12 plus that of the programmable voltage source 14 and the rate of rise of current in the inductor will be greater. Similarly, during the off period of the power switch 22, the rate of fall of current in the inductor 24 will also depend on the state of the load switch 42.

Thus, the pulse width ratio controlling the power switch 22 will have to change in a defined manner and in direct relationship to the changing voltage across the inductor 24 to maintain the current in the inductor 24 at the level defined by the reference current programming input to the error amplifier 28.

The state of the load switch 42 changes so rapidly, and at such a frequency, that the slower main control loop cannot adjust the error amplifier 28 output quickly enough to avoid significant overshoots in the current level within the inductor 24.

This problem is overcome by sensing the voltage at the output to the inductor 24 (that is, at the anode of the catching diode 18), dividing this value by that at the input to the inductor 24 (that is, at the drain of the power switch 22), multiplying the result by an appropriate scaling factor and adding it to the output from the error amplifier 28 to allow the pulse width ratio at the output of the comparator 32 to be immediately adjusted to compensate for voltage changes across the inductor 24. This approach may radically reduce overshoots in the current amplitude of the inductor 24 in response to dynamic changes in the state of the load switch 42, or load switch 40.

When current is flowing in the inductor 24, the power switch 22 is off, and the catching and flyback diodes 18 and 38 are forward biassed, energy flows from the inductor 24 into the programmable voltage source 14. As a result, the voltage at the positive side of the programmable voltage source 14 will rise rapidly unless the energy from the inductor 24 is dissipated in some way. The constant power dump circuit 20 performs this function. On sensing the rising voltage on its positive terminal, the programmable voltage source 14 turns on the constant power dump. The constant power dump senses the voltage across its terminals and dumps a current level which is in inverse proportion to the voltage across it. In this example, the power dumped is 160 watts. In the above power simulator module an isolated current sensor 26 is used to provide an output signal proportional to the current flowing through the inductor 24. This signal is electrically isolated from the inductor 24 circuit, so when large, rapid, voltage changes occur at the output of the inductor 24, the noise coupled to the current sensor 26 output sensor is minimised. An example of the type of isolated current sensor that can be used is the HT100 produced by CONTEC.

Figure 4:
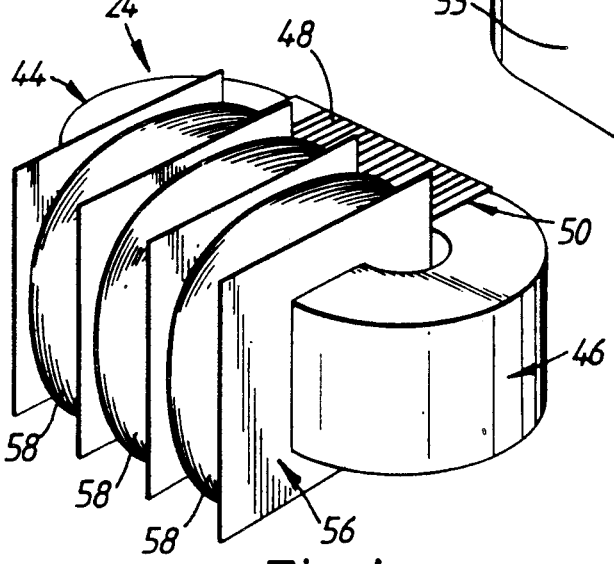
FIG. 4 is a perspective view of the inductor used in the switched mode power supply of FIG. 3.
Figure 5:
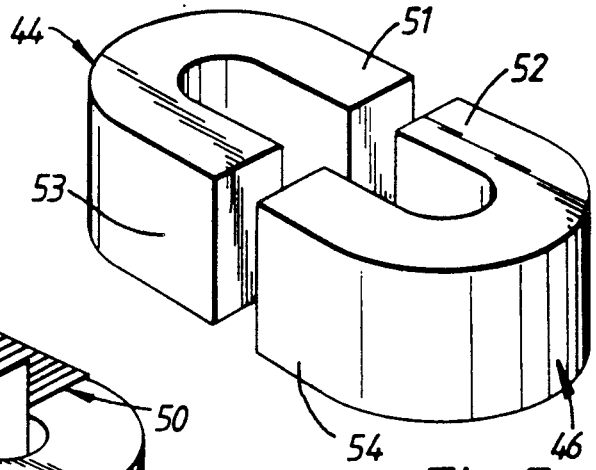
FIG. 5 is a perspective view of the two C-shaped halves of the core of the inductor of FIG. 4.
Figure 6:
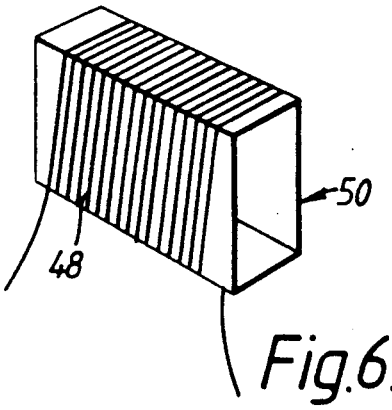
FIG. 6 is a perspective view of the single layer winding and former of the inductor of FIG. 4.
Figure 7:
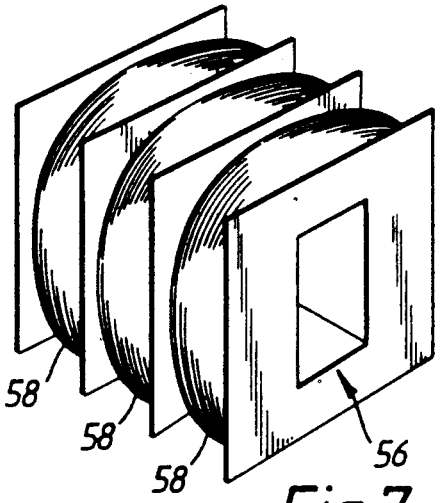
FIG. 7 is a perspective view of the multi-layer sectionalised windings of the inductor of FIG. 4.
Figure 8:
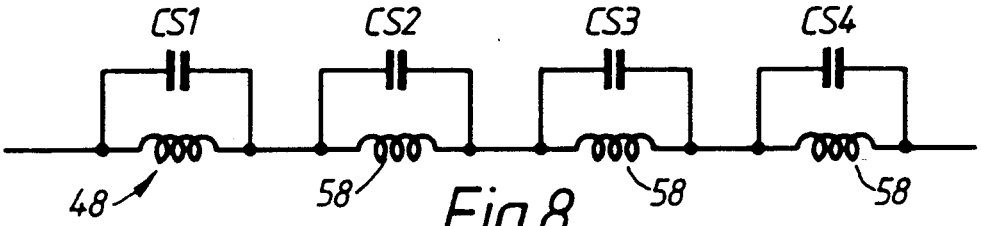
FIG. 8 is the electrical equivalent circuit of the inductor of FIG. 7.

Referring to FIGS. 4 to 8, the inductor 24 is of a special construction. The power switch 22 can be operating at frequencies in excess of 100 KHz (with rise and fall times of less than 50 nS) and the inductor 24 value required can exceed 20 mH, and large spikes can appear on the output waveform unless the stray capacitance across the inductor is minimised. A special winding technique is provided for the inductor which is shown in FIG. 4. The magnetic core of the inductor 24 is formed by two halves of laminated steel 44 and 46 (FIG. 5). A single copper winding 48 (FIG. 6) is wound, in a single layer, around (for example) a teflon former 50 which slides over the C-core limbs 51 and 52 or 53 and 54 in FIG. 5. This single layer construction forms a low stray capacitance input inductor section which is then connected in series with the main inductor section. The main inductor sectionalised winding is shown in FIG. 7. A three section former 56, made for example of teflon, has insulated copper wire wound in each of its sections to form a multi-layer winding. The three windings 58 are then connected in series such that their magnetic fields are additive, that is, there is no field cancellation. This section is then connected in series with the low capacitance single layer winding 48 so that the magnetic fields do not oppose each other. In this way, a low capacitance inductor 24 is constructed which minimises spike feedthrough to the output and allows the very narrow pulse widths (of the order of 50 nS) to be present at its input without being seriously attenuated. The electrical equivalent circuit of the inductor is shown in FIG. 8 and CS1, CS2, CS3 and CS4 represent the stray capacitance values across each section of the four section inductor winding. The construction described ensures that CS1 is much less than CS2, CS3 or CS4. The series connection of the components ensures an overall low stray capacitance inductor.

We claim:

1. A power supply for supplying power to a switched regulator, said power supply comprising positive and negative output means, a first voltage source, a second voltage source and a programmable current source, said sources being connected in series with each other between said output means, load switch means operable to modulate the power outputs, and bypass means connected in parallel with said current source and one of said first and second voltage sources and operable so that when said output means are open circuit only said one voltage source is applied across said current source, but when said output means are shorted both said voltage sources are applied across said current source.

2. A power supply according to claim 1, wherein said by-pass means includes catching diode means.

3. A power supply according to claim 1, wherein said current source is a switched mode current source.

4. A power supply according to claim 3, wherein said switched mode current source includes switch means and inductor means, said supply further including flyback diode means clamping the inductor means to the negative output means.

5. A power supply according to claim 4, including power dissipation means operable for dissipating electrical energy when both said by-pass means and said flyback diode means are conducting.

6. A power supply according to claim 5, wherein said power dissipation means is actuated in response to the voltage across said second voltage source.

7. A power supply according to claim 5, wherein said power dissipation means is operable to dissipate a substantially constant level of power.

8. A power supply according to claim 4, including a relatively slow control loop responsive to the current flowing in said inductor means to apply a pulse-width-modulated switch signal to said switch means, and a relatively fast control loop responsive to the voltage across said inductor means for modifying said switching signal to compensate for changes in said inductor voltage.

9. A power supply according to claim 8, wherein said fast control loop includes means for sensing the voltage at the input and output of said inductor means.

10. A power supply according to claim 9, wherein the input and output inductor voltages are supplied to divider means and the output from said divider means is used to modify said switching signal.

11. A power supply according to claim 8, wherein said relatively slow control loop includes an isolated current sensor, for detecting the inductor current.

12. A power supply according to claim 11, wherein said isolated current sensor comprises a Hall effect current sensor.

13. A power supply according to claim 4, wherein said inductor means comprises a low capacitance input inductor section connected in series with a sectionalised winding.

14. A power supply according to claim 13, wherein said low capacitance inductor section comprises a single layer winding and said sectionalised winding comprises a plurality of multi-layer windings connected in series, with each of said windings arranged such that their magnetic fields are additive.

15. A power supply according to claim 1, wherein said first voltage source is a constant voltage source, and said second voltage source is a programmable voltage source.

* * * * *